US009738841B2

(12) United States Patent
Ohara

(10) Patent No.: US 9,738,841 B2
(45) Date of Patent: Aug. 22, 2017

(54) GASIFIED GAS PRODUCTION SYSTEM

(71) Applicant: IHI Corporation, Tokyo (JP)

(72) Inventor: Hiroaki Ohara, Tokyo (JP)

(73) Assignee: IHI Corporation, Tokyo (JP)

( * ) Notice: Subject to any disclaimer, the term of this patent is extended or adjusted under 35 U.S.C. 154(b) by 0 days.

(21) Appl. No.: 14/828,655

(22) Filed: Aug. 18, 2015

(65) Prior Publication Data

US 2015/0353850 A1 Dec. 10, 2015

Related U.S. Application Data

(63) Continuation of application No. PCT/JP2014/060407, filed on Apr. 10, 2014.

(30) Foreign Application Priority Data

Apr. 15, 2013 (JP) ..... 2013-085131

(51) Int. Cl.
*C10J 3/84* (2006.01)
*C10J 3/48* (2006.01)
(Continued)

(52) U.S. Cl.
CPC ..... *C10J 3/84* (2013.01); *C10J 3/463* (2013.01); *C10J 3/485* (2013.01); *C10K 3/023* (2013.01); *C10J 2200/15* (2013.01); *C10J 2300/093* (2013.01); *C10J 2300/0916* (2013.01); *C10J 2300/0946* (2013.01); *C10J 2300/0976* (2013.01); *C10J 2300/0993* (2013.01); *C10J 2300/12* (2013.01); *C10J 2300/1637* (2013.01); *C10J 2300/1807* (2013.01); *C10J 2300/1853* (2013.01)

(58) Field of Classification Search
CPC ..... C10J 3/84
See application file for complete search history.

(56) References Cited

U.S. PATENT DOCUMENTS

2004/0244289 A1 12/2004 Morozumi et al.
2007/0094929 A1* 5/2007 Kang ..... C10J 3/54 48/111
(Continued)

FOREIGN PATENT DOCUMENTS

CN 202543155 11/2012
CN 102807901 12/2012
(Continued)

OTHER PUBLICATIONS

Machine translation of JP2009-280633A (Apr. 13, 2016).*
International Search Report issued Jun. 10, 2014 in PCT/JP2014/060407 filed Apr. 10, 2014.

*Primary Examiner* — Matthew Merkling
(74) *Attorney, Agent, or Firm* — Oblon, McClelland, Maier & Neustadt, L.L.P.

(57) ABSTRACT

A gasified gas production system of the present disclosure includes a gasification furnace which produces a gasified gas by gasifying a gasification raw material, a flow passage through which the gasified gas produced in the gasification furnace flows, a catalyst-holding unit which holds a catalyst which promotes reforming of tar included in the gasified gas inside the flow passage, and an oxidation agent supply unit which supplies an oxidation agent with a temperature of 200° C. to 900° C. to the catalyst.

5 Claims, 3 Drawing Sheets

(51) Int. Cl.
*C10J 3/46* (2006.01)
*C10K 3/02* (2006.01)

(56) References Cited

U.S. PATENT DOCUMENTS

| | | | | |
|---|---|---|---|---|
| 2009/0126271 | A1* | 5/2009 | Kyo | C10J 3/463 48/77 |
| 2010/0305220 | A1* | 12/2010 | Kukkonen | C01B 3/38 518/700 |
| 2012/0107208 | A1* | 5/2012 | Ohara | F23J 15/006 423/239.1 |
| 2013/0026417 | A1* | 1/2013 | Paquet | C10J 3/485 252/373 |

FOREIGN PATENT DOCUMENTS

| | | |
|---|---|---|
| JP | 11-21564 | 1/1999 |
| JP | 2003-238973 | 8/2003 |
| JP | 2007-112872 | 5/2007 |
| JP | 2009-13184 | 1/2009 |
| JP | 2009-040862 | 2/2009 |
| JP | 2009-280633 | 12/2009 |

* cited by examiner

GASIFIED GAS PRODUCTION SYSTEM

This application is a continuation application based on a PCT Patent Application No. PCT/JP2014/060407, filed Apr. 10, 2014, whose priority is claimed on Japanese Patent Application No. 2013-85131, filed Apr. 15, 2013. The contents of both the PCT application and the Japanese Patent Application are incorporated herein by reference.

TECHNICAL FIELD

The present disclosure relates to a gasified gas production system for producing a gasified gas by gasifying a gasification raw material.

BACKGROUND ART

In recent years, technologies for producing a gasified gas by gasifying a gasification raw material such as coal and fuels that were not used before, including biomass, tire chips, and the like, instead of petroleum have been developed. Such a gasified gas produced in that manner is being used in power generation systems, production of hydrogen, production of synthetic fuels (synthetic petroleum), and production of chemical products such as chemical fertilizer (urea). Among gasification raw materials which serve as raw materials of a gasified gas, coal in particular can be mined for the next 150 years, which is three times longer than petroleum, and deposit areas thereof are more evenly distributed than those of petroleum, and thus it is expected as one of the natural resources that can be stably supplied for a long period of time.

In the past, a gasification process of coal was performed through partial oxidation using oxygen or air, but due to the necessity of partial oxidation at a high temperature of 2000° C., the process has a drawback of increasing costs of a gasification furnace.

In order to overcome this problem, a technology for gasifying coal at a temperature of about 700° C. to 900° C. using water vapor (water vapor gasification) has been developed. In this technology, costs can be reduced by setting a low temperature. However, a gasified gas produced thus often includes a larger amount of tar than a gasified gas produced through partial oxidation at the high temperature of 2000° C. When the temperature of a gasified gas is lowered in the process in which the gasified gas produced through the water vapor gasification is used, tar included in the gasified gas condenses, which causes a problem of clogging of a pipe, breakdown of a device used in the process, poisoning of a catalyst, or the like.

Thus, a technology for removing tar included in a gasified gas by combusting the produced gasified gas with oxygen or air to raise its temperature to 1100° C. or higher thereby causing tar to undergo oxidation reforming has been disclosed (for example, Patent Document 1).

DOCUMENT OF RELATED ART

Patent Document

[Patent Document 1]
Japanese Unexamined Patent Application, First Publication No. 2009-40862A

SUMMARY

Technical Problem

However, in order to perform oxidation reforming for tar as described above, it is necessary to raise the temperature of an oxidation reforming furnace used for an oxidation reforming reaction to 1100° C. or higher. In order to raise the temperature of the oxidation reforming furnace, a combustible gas (hydrogen or methane) included in the gasified gas should be combusted with oxygen or air. Accordingly, since the combustible gas included in the gasified gas is consumed (combusted), the ratio of the combustible gas to the gasified gas processed in the oxidation reforming furnace per unit volume may decrease.

Therefore, the inventor of the present application developed a technology for removing tar included in a gasified gas produced in a gasification furnace through oxidation reforming by causing a catalyst that promotes reforming of tar to come in contact with the gasified gas and an oxidation agent. In this technology, as an oxidation agent for oxidation reforming of tar, for example, air at room temperature (about 25° C.) is used.

In this tar removal technology developed by the inventor of the present application, since a catalyst is used, it is possible to remove tar with high efficiency and suppress a reduction of the combustible gas, in comparison to the technology disclosed in Patent Document 1. However, development of a technology of further suppressing a reduction of a combustible gas has been demanded.

The present disclosure takes the above problems into consideration, and aims to provide a gasified gas production device that can further suppress a reduction of a combustible gas while removing tar with high efficiency.

Solution to Problem

To solve the above-described problems, a gasified gas production system of the present disclosure includes a gasification furnace which produces a gasified gas by gasifying a gasification raw material, a flow passage through which the gasified gas produced by the gasification furnace flows, a catalyst-holding unit which holds a catalyst that promotes reforming of tar included in the gasified gas inside the flow passage, and an oxidation agent supply unit which supplies an oxidation agent with a temperature of 200° C. to 900° C. to the catalyst.

In addition, a combustion furnace which heats a fluid medium with heat generated by combusting a fuel may be further included, the fluid medium heated by the combustion furnace may be introduced into the gasification furnace, the gasification furnace may gasify the gasification raw material with heat of the fluid medium, and the oxidation agent supply unit may heat the oxidation agent to a temperature of 200° C. to 900° C. by performing heat exchange between a combustion exhaust gas generated by combusting the fuel in the combustion furnace and the oxidation agent.

In addition, a combustion furnace which heats a fluid medium with heat generated by combusting a fuel may be further included, the fluid medium heated by the combustion furnace may be introduced into the gasification furnace, the gasification furnace may gasify the gasification raw material with heat of the fluid medium, and the oxidation agent supply unit may supply a combustion exhaust gas with a temperature of 200° C. to 900° C. generated by combusting the fuel in the combustion furnace to the catalyst as an oxidation agent.

In addition, a temperature-measuring unit which measures a temperature of the catalyst, and an oxidation agent control unit which controls an amount of the oxidation agent supplied by the oxidation agent supply unit according to the measured temperature of the catalyst may be further included.

In addition, water vapor may be introduced into the gasification furnace, and the gasification furnace may gasify the gasification raw material with the water vapor.

Effects of the Disclosure

According to the present disclosure, it is possible to further suppress a reduction of a combustible gas while tar is removed with high efficiency.

DESCRIPTION OF EMBODIMENTS

Figure 1:
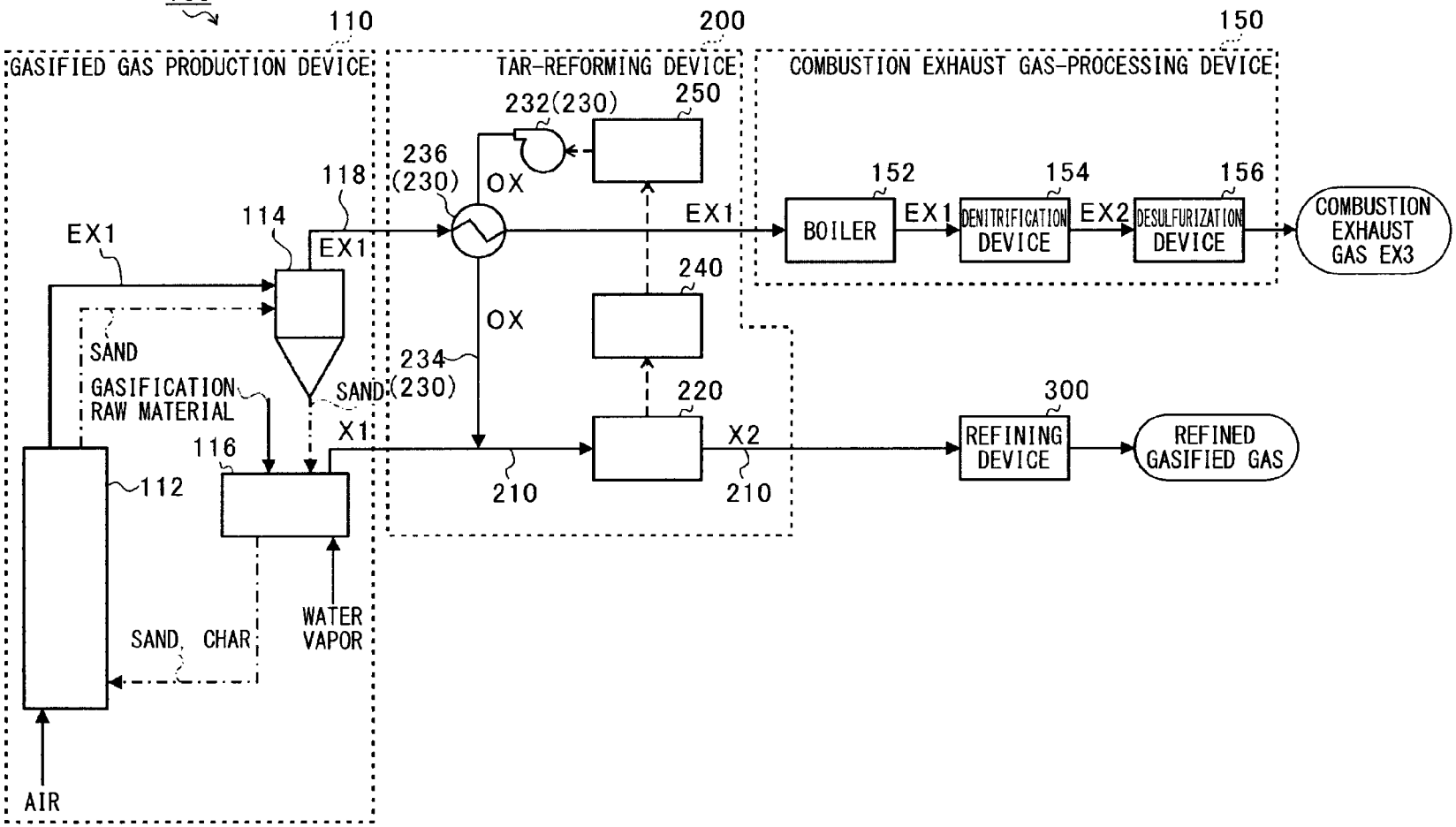
FIG. 1 is a conceptual diagram describing a gasified gas production system according to a first embodiment.

Hereinafter, exemplary embodiments of the present disclosure will be described in detail with reference to the accompanying drawings. Sizes, materials, specific numeric values, and the like shown in the embodiments are merely examples by which the disclosure may be easily understood, and do not limit the present disclosure unless specifically noted. It should be noted that, in the present specification and drawings, the same reference numerals are given to elements that have substantially the same functions and configurations and overlapping description is omitted. In addition, elements that are not directly related to the present disclosure are not illustrated.

First Embodiment: Gasified Gas Production System 100

FIG. 1 is a conceptual diagram describing a gasified gas production system 100 according to a first embodiment. As illustrated in FIG. 1, the gasified gas production system 100 is configured to include a gasified gas production device 110, a combustion exhaust gas-processing device 150, a tar-reforming device 200, and a refining device 300. It should be noted that, in FIG. 1, the flows of a gasification raw material, a gas, water vapor, air, and an oxidation agent are indicated with solid-lined arrows, the flow of a fluid medium (sand) is indicated with the dashed-dotted-lined arrow, and the flow of a signal is indicated with the dashed-lined arrow.

Gasified Gas Production Device 110

The gasified gas production device 110 is configured to include a combustion furnace 112, a medium separator (cyclone) 114, and a gasification furnace 116. In the gasified gas production device 110, a fluid medium that includes sand such as silica sand having a particle diameter of about 300 μm (silica sand) and the like is set to circulate throughout the device as a heating medium. Specifically, the fluid medium is first heated to about 1000° C. in the combustion furnace 112, and then introduced into the medium separator 114 together with a combustion exhaust gas EX1. In the medium separator 114, the high-temperature fluid medium and the combustion exhaust gas EX1 are separated from each other, and the separated high-temperature fluid medium is introduced into the gasification furnace 116. Then, the fluid medium introduced into the gasification furnace 116 turns into a fluidized bed due to a gasification agent (water vapor) that is introduced from the bottom of the gasification furnace 116, and then finally returns to the combustion furnace 112.

On the other hand, the combustion exhaust gas EX1 separated in the medium separator 114 is emitted to the combustion exhaust gas-processing device 150 through an exhaust passage 118, processed in the combustion exhaust gas-processing device 150, and then emitted to the outside.

The gasification furnace 116 is, for example, a bubble fluidized bed gasification furnace, in which a gasification raw material including a solid raw material such as coal like lignite, petroleum coke (petro coke), biomass, or tire chips or a liquid raw material such as black liquor is gasified at a temperature of 700° C. to 900° C., and thereby a gasified gas is produced. In the present embodiment, a gasification raw material is gasified and thereby a gasified gas is produced by supplying water vapor to the gasification furnace 116 (water vapor gasification).

It should be noted that, although a circulating fluidized bed system has been described herein as an example of the gasification furnace 116, the gasification furnace 116 may adopt a simple fluidized bed system or a moving bed system in which a moving bed is formed as sand flows down in the vertically downward direction due to its own weight as long as a gasification raw material can be gasified therein.

Because a gasified gas X1 produced in the gasification furnace 116 includes tar, water vapor, and the like, it is sent to the tar-reforming device 200 and the refining device 300 on the downstream side to be refined.

Combustion Exhaust Gas-Processing Device 150

The combustion exhaust gas-processing device 150 is configured to include a boiler 152, a denitrification device 154, and a desulfurization device 156. The boiler 152 recovers heat of the combustion exhaust gas EX1 by performing heat exchange with the combustion exhaust gas EX1 separated in the medium separator 114 and water. The denitrification device 154 removes NOx (nitrogen oxide) from the combustion exhaust gas EX1 that has been cooled by the boiler 152. The desulfurization device 156 removes SOx (sulfur oxide) from a combustion exhaust gas EX2 from which NOx has been removed by the denitrification device 154. In this manner, a combustion exhaust gas EX3 from which NOx and SOx have been removed is emitted to the outside.

Tar-Reforming Device 200

As illustrated in FIG. 1, the tar-reforming device 200 is configured to include a flow passage 210, a catalyst-holding unit 220, an oxidation agent supply unit 230, a temperature-measuring unit 240, and an oxidation agent control unit 250.

The flow passage 210 is a flow path on which the gasified gas X1 at about 700° C. produced in the gasification furnace 116 flows.

The catalyst-holding unit 220 holds a catalyst that promotes reforming of tar included in the gasified gas X1 inside the flow passage 210. Any catalyst is possible as long as it promotes reforming of tar, and for example, a Ni (nickel)-based catalyst, an Fe (iron)-based catalyst, a Ru (ruthenium)-based catalyst, a Rh (rhodium)-based catalyst, a Co (cobalt)-based catalyst, or an ore-based catalyst can be employed.

Any Ni-based catalyst is possible as long as it includes at least Ni as an active species, any Fe-based catalyst is possible as long as it includes at least Fe as an active species, any Ru-based catalyst is possible as long as it includes at least Ru as an active species, any Rh-based catalyst is possible as long as it includes at least Rh as an active species, and any Co-based catalyst is possible as long as it includes at least Co as an active species.

As a carrier of the active species for these catalysts, for example, aluminum oxide ($Al_2O_3$), zirconia ($ZrO_2$), cerium oxide ($CeO_2$), silicon oxide ($SiO_2$), magnesium (Mg), magnesium oxide (MgO), or a natural ore can be used.

In addition, an ore-based catalyst is an oxide or carbonate having one or a plurality of elements selected from the group of Ca (calcium), Mg, Fe, and Si (silicon), and is a natural ore, for example, dolomite, olivine, limonite ore, or limestone.

The oxidation agent supply unit 230 supplies an oxidation agent OX (for example, air, or oxygen) with a temperature of 200° C. to 900° C. to the catalyst on the flow passage 210. Herein, a case in which the oxidation agent supply unit 230 supplies air as the oxidation agent OX will be described as an example. In addition, in the present embodiment, the oxidation agent supply unit 230 supplies the oxidation agent OX to the catalyst by introducing the oxidation agent OX upstream from the catalyst-holding unit 220 on the flow passage 210.

Specifically, in the present embodiment, the oxidation agent supply unit 230 is configured to include a blower 232, an oxidation agent supply passage 234, and a heat exchanger 236. The blower 232 introduces air into the oxidation agent supply passage 234. The oxidation agent supply passage 234 is a passage through which the oxidation agent OX flows, and connects the blower 232 to the flow passage 210 upstream from the catalyst-holding unit 220. Thus, the oxidation agent OX introduced by the blower 232 passes through the oxidation agent supply passage 234, and then is supplied to the catalyst-holding unit 220 (upstream from the catalyst-holding unit 220 on the flow passage 210).

With the configuration of the oxidation agent supply unit 230 supplying the oxidation agent OX, hydrogen sulfide ($H_2S$) included in the gasified gas X1 adsorbs the catalyst, but it can be decomposed, and poisoning (adsorption) of the catalyst caused by sulfur derived from the hydrogen sulfide can be reduced.

In addition, with the configuration of the oxidation agent supply unit 230 supplying the oxidation agent OX, a linear unsaturated hydrocarbon included in the tar (for example, ethylene, acetylene, propylene, or the like) can undergo partial oxidation to be decomposed into carbon monoxide or carbon dioxide, and thus poisoning (precipitation) of the catalyst caused by carbon derived from the linear unsaturated hydrocarbon can be reduced.

Furthermore, with the configuration of the oxidation agent supply unit 230 supplying the oxidation agent OX with a high temperature of 200° C. to 900° C., it is possible to raise the temperature of the gasified gas X1 with a smaller amount of hydrogen than when the oxidation agent OX with a relatively low temperature (for example, 25° C.) is supplied.

Specifically, taking an activation temperature of the catalyst or an adsorption rate of sulfur into account, a preferable temperature of the gasified gas X1 is defined as an optimum temperature. When the oxidation agent OX is supplied to combust some hydrogen included in the gasified gas X1 in order to raise the temperature of the gasified gas X1 to the optimum temperature, the amount of hydrogen necessary to raise the temperature of (to combust) the gasified gas X1 to the optimum temperature is smaller when the oxidation agent OX with a relatively high temperature (for example, 200° C. to 900° C.) is supplied than when the oxidation agent OX with a relatively low temperature (for example, 25° C.) is supplied.

Therefore, with the configuration of the oxidation agent supply unit 230 supplying the oxidation agent OX with a high temperature of 200° C. to 900° C. to the catalyst, the temperature of the catalyst can be raised while consumption of a combustible gas (hydrogen or methane) is reduced in comparison to a case in which the oxidation agent OX with a relatively low temperature is supplied to the catalyst, and thus activation of the catalyst can be improved. That is to say, tar reforming efficiency (a reaction speed of a tar reforming reaction) by the catalyst can increase. In addition, by raising the temperature of the gasified gas X1, the adsorption amount of sulfur with respect to the catalyst can be reduced. Therefore, a decrease in tar reforming efficiency resulting from adsorption of sulfur with respect to the catalyst can be suppressed.

The heat exchanger 236 performs heat exchange between the oxidation agent OX that flows through the oxidation agent supply passage 234 and the combustion exhaust gas EX1 that flows through the exhaust passage 118 (between the medium separator 114 and the boiler 152), thereby heating the oxidation agent OX with the heat of the combustion exhaust gas EX1.

The temperature of the combustion exhaust gas EX1 flowing through the exhaust passage 118 (between the medium separator 114 and the boiler 152) is about 800° C. to 950° C. Thus, by the heat exchanger 236 heating the oxidation agent OX with the heat of the combustion exhaust gas EX1, the temperature of the oxidation agent OX to be supplied to the catalyst-holding unit 220 can be raised to 200° C. to 900° C.

Thus, the oxidation agent OX can be heated without requiring an extra heating source, and thus consumption energy for heating the oxidation agent OX can be cut.

The temperature-measuring unit 240 measures the temperature of the catalyst. The oxidation agent control unit 250 is configured with a semiconductor integrated circuit including a central processing unit (CPU), reads programs, parameters, and the like for causing the CPU to operate from a ROM, and manages and controls the entire tar-reforming device 200 in cooperation with a RAM serving as a work area and another electronic circuit. In the present embodiment, the oxidation agent control unit 250 controls an amount of the oxidation agent OX that the oxidation agent supply unit 230 supplies according to the temperature of the catalyst measured by the temperature-measuring unit 240.

Specifically, the oxidation agent control unit 250 controls an amount of the oxidation agent OX that the oxidation agent supply unit 230 supplies so that the temperature of the catalyst does not fall below the activation temperature of the catalyst (for example, 650° C. to 900° C.) measured by the temperature-measuring unit 240. For example, when hysteresis control is performed and the temperature of the catalyst becomes lower than 700° C., the oxidation agent control unit 250 controls a driving amount of the blower 232 so that the amount of the oxidation agent OX to be supplied to the catalyst increases, and when the temperature of the catalyst becomes higher than 850° C., controls a driving amount of the blower 232 so that the amount of the oxidation agent OX to be supplied to the catalyst decreases.

With the configuration described above, the catalyst can be maintained to have the activation temperature or higher, and reforming efficiency of tar can be maintained.

As described above, tar included in the gasified gas X1 (tar-including gas) is reformed by the tar-reforming device 200 and turns into a gasified gas X2.

Refining Device 300

Figure 2:
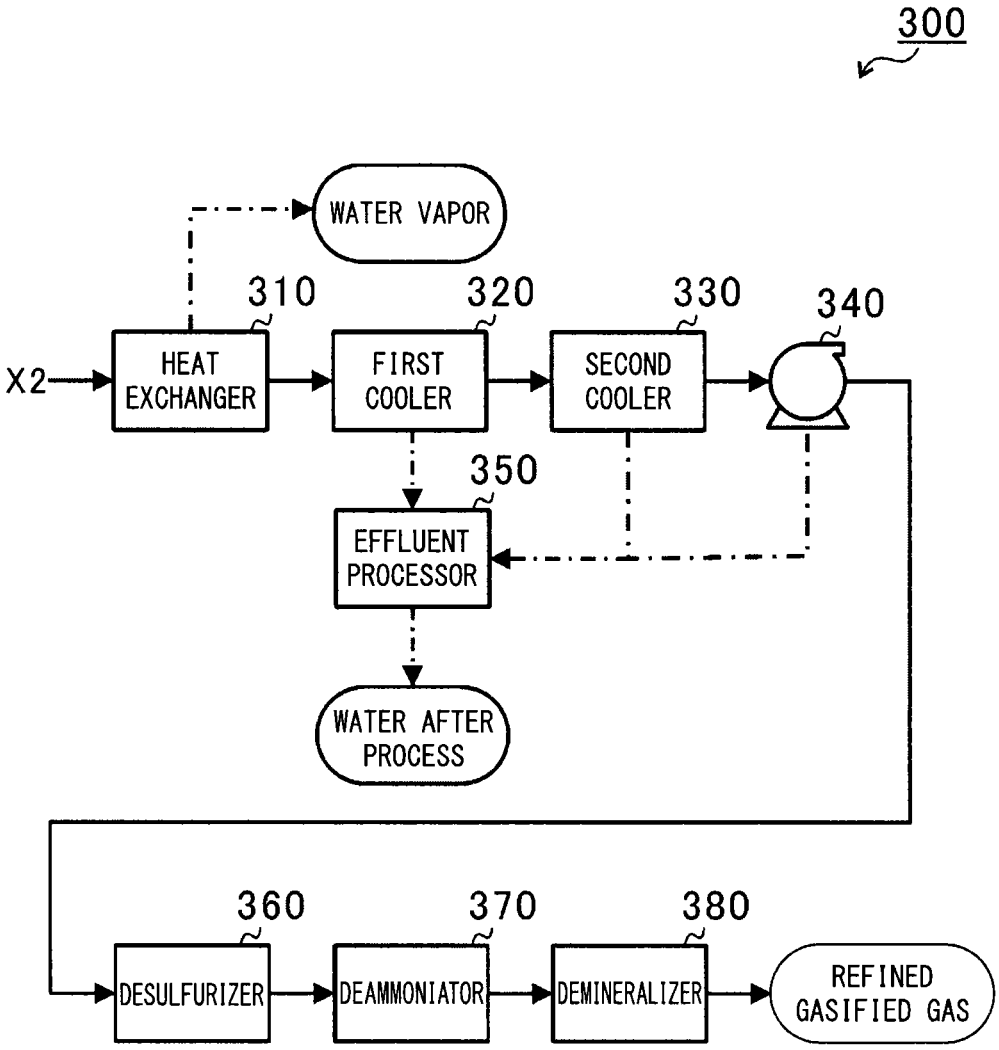
FIG. 2 is a diagram describing a refining device according to the first embodiment.

FIG. 2 is a diagram for describing the refining device 300. As illustrated in FIG. 2, the refining device 300 is configured to include a heat exchanger 310, a first cooler 320, a second cooler 330, a booster 340, an effluent processor 350, a desulfurizer 360, a deammoniator 370, and a demineralizer 380. It should be noted that, the inclusion and the order of the desulfurizer 360, the deammoniator 370, and the demineralizer 380 can vary according to the application of the gasified gas X2 and a gasification raw material. It should be noted that, in FIG. 2, the flows of a gas are indicated with solid-lined arrows, and the flows of water are indicated with dashed-dotted-lined arrows.

The heat exchanger 310 performs heat exchange between the gasified gas X2 introduced from the tar-reforming device 200 and water vapor, in other words, recovers sensible heat of the gasified gas X2 with water vapor, and the outlet temperature of the gasified gas X2 reaches 300° C. to 600° C.

The first cooler 320 further cools the gasified gas X2 that has cooled to the temperature of 300° C. to 600° C. by spraying water. Accordingly, tar and dust remaining in the gasified gas X2 are caused to condense and then removed from the gasified gas X2.

The second cooler 330 further cools the gasified gas X2 to 30° C. or lower using seawater, brine, or the like, and further remaining tar and dust are caused to condense and removed. It should be noted that tar and dust can be further removed by a mist and dust remover configured with an electric dust collector or the like provided in a subsequent stage of the second cooler 330.

The booster 340 is constituted with a blower, a compressor, a turbo-type pump, a volume-type pump, or the like, and boosts pressure of the gasified gas X2 that has passed through the second cooler 330 to 0.1 MPa to 5 MPa. It should be noted that tar and dust can also be further removed by a cooler that cools the gasified gas X2 to 30° C. or lower provided in a subsequent stage of the booster 340.

The effluent processor 350 performs a process of removing tar and dust from effluent which includes tar and dust generated by the first cooler 320, the second cooler 330, and the booster 340. Water processed by the effluent processor 350 (processed water) is reused in the heat exchanger 310, the first cooler 320, and the like.

The desulfurizer 360 removes sulfur or sulfur compounds remaining in the gasified gas X2. The deammoniator 370 removes nitrogen compounds such as ammonia included in the gasified gas X2. The demineralizer 380 removes chloride and chlorine compounds included in the gasified gas X2.

As described above, the gasified gas X2 which has been produced in the gasified gas production system 100 and whose tar has been reformed in the tar-reforming device 200 is refined by removing tar and dust using the heat exchanger 310, the first cooler 320, the second cooler 330, and the booster 340, sulfur using the desulfurizer 360, ammonia using the deammoniator 370, and chloride using the demineralizer 380, and thereby turns into a refined gasified gas.

As described above, according to the gasified gas production system 100 of the present embodiment, since reforming of tar is promoted using the catalyst, there is no need to raise the temperature of the gasified gas X1 to a high temperature, in comparison to a related art in which tar is reformed using an oxidation reforming furnace. Thus, tar can be reformed with high efficiency while consumption of a combustible gas (hydrogen or methane) is reduced. In addition, with the configuration of the oxidation agent supply unit 230 supplying the catalyst to the oxidation agent OX having a high temperature of 200° C. to 900° C., consumption of the combustible gas can be reduced and reduction of the combustible gas included in the gasified gas X2 can be further suppressed in comparison to a case in which the oxidation agent OX with a relatively low temperature is supplied to the catalyst.

Second Embodiment

In the first embodiment described above, the case in which the oxidation agent OX having a temperature of 200° C. to 900° C. is produced with heat of the combustion exhaust gas EX1 emitted from the medium separator 114 and supplied to the catalyst has been described. In the present embodiment, a gasified gas production system 400 in which an oxidation agent having a temperature of 200° C. to 900° C. is supplied to a catalyst using another method will be described.

Gasified Gas Production System 400

Figure 3:
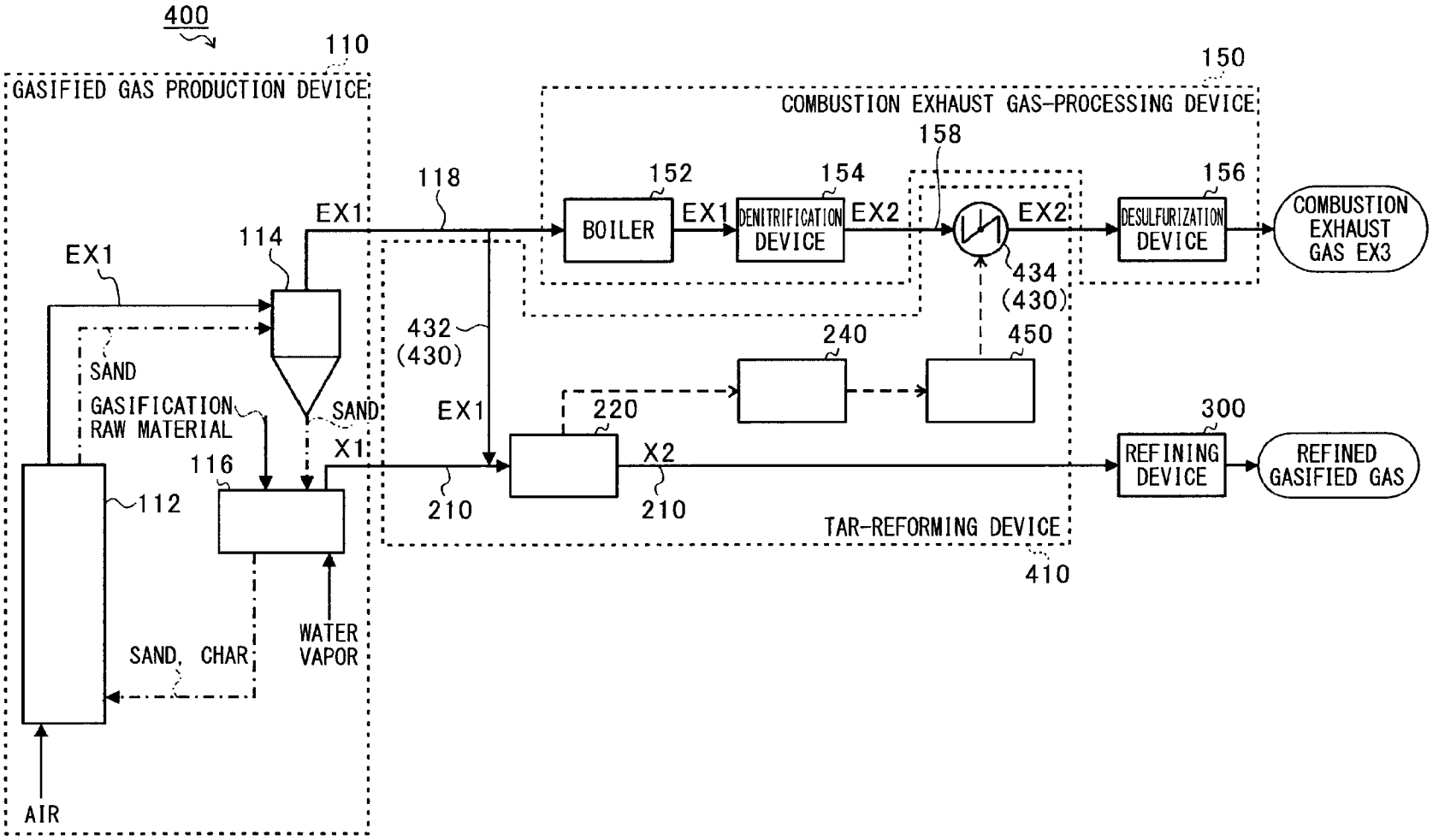
FIG. 3 is a conceptual diagram describing a gasified gas production system according to a second embodiment.

FIG. 3 is a conceptual diagram for describing the gasified gas production system 400 according to a second embodiment. In FIG. 3, the flows of a gasification raw material, a gas, water vapor, air, and an oxidation agent are indicated with solid-lined arrows, the flows of a fluid medium (sand) are indicated with dashed-dotted-lined arrows, and the flows of a signal are indicated with dashed-lined arrows. As illustrated in FIG. 3, the gasified gas production system 400 is configured to include the gasified gas production device 110, the combustion exhaust gas-processing device 150, a tar-reforming device 410, and the refining device 300. In addition, the tar-reforming device 410 is configured to include the flow passage 210, the catalyst-holding unit 220, an oxidation agent supply unit 430, the temperature-measuring unit 240, and an oxidation agent control unit 450.

It should be noted that, since the gasified gas production device 110, the combustion exhaust gas-processing device 150, the flow passage 210, the catalyst-holding unit 220, the temperature-measuring unit 240, and the refining device 300 that were already described above in the first embodiment have substantially identical functions to those in this embodiment, overlapping description thereof is omitted, and the oxidation agent supply unit 430 and the oxidation agent control unit 450 which have different functions herein will be described in detail.

The oxidation agent supply unit 430 supplies the combustion exhaust gas EX1 to a catalyst as an oxidation agent. The combustion exhaust gas EX1 emitted from the combustion furnace 112 (the medium separator 114) includes oxygen that functions as the oxidation agent. Thus, by supplying the combustion exhaust gas EX1 to the catalyst as the oxidation agent, costs required for the oxidation agent can be cut.

In addition, as described above, the temperature of the combustion exhaust gas EX1 that flows through the exhaust passage 118 (between the medium separator 114 and the boiler 152) is about 800° C. to 950° C. Thus, by supplying the combustion exhaust gas EX1 to the catalyst as an oxidation agent, the oxidation agent (combustion exhaust gas EX1) with a high temperature of 200° C. to 900° C. can be supplied to the catalyst without requiring an extra heating source, and consumption energy for heating the oxidation agent (combustion exhaust gas EX1) can be cut.

To describe a specific configuration of the oxidation agent supply unit 430, the oxidation agent supply unit 430 is configured to include an oxidation agent supply passage 432 and a butterfly valve 434 in the present embodiment.

The oxidation agent supply passage 432 is a flow passage through which the combustion exhaust gas EX1 flows, diverging from the exhaust passage 118 and being connected upstream from the catalyst-holding unit 220 on the flow passage 210.

The butterfly valve 434 is provided on an exhaust passage 158 which connects the denitrification device 154 and the desulfurization device 156, whose degree of opening is controlled by the oxidation agent control unit 450 to be described below.

The oxidation agent control unit 450 is configured with a semiconductor integrated circuit including a central processing unit (CPU), reads programs, parameters, and the like for causing the CPU to operate from a ROM, and manages and controls the entire tar-reforming device 410 in cooperation with a RAM serving as a work area and another electronic circuit. In the present embodiment, the oxidation agent control unit 450 controls an amount of the combustion exhaust gas EX1 supplied by the oxidation agent supply unit 430 according to a temperature of the catalyst measured by the temperature-measuring unit 240.

Specifically, the oxidation agent control unit 450 controls the amount of the combustion exhaust gas EX1 supplied by the oxidation agent supply unit 430 so that the temperature of the catalyst does not fall below the activation temperature of the catalyst (for example, 650° C. to 900° C.). For example, the oxidation agent control unit 450 performs hysteresis control to control the degree of opening of the butterfly valve 434 so that the amount of the combustion exhaust gas EX1 to be supplied to be catalyst increases when the temperature of the catalyst is lower than 700° C., and controls the degree of opening of the butterfly valve 434 so that the amount of the combustion exhaust gas EX1 to be supplied to the catalyst decreases when the temperature of the catalyst is equal to or higher than 850° C.

With the configuration described above, the catalyst can be maintained at the activation temperature or higher, and tar reforming efficiency can be maintained.

As described above, since it is not necessary to set a temperature of the gasified gas X1 to a high temperature in comparison to a related art for reforming tar using an oxidation reforming furnace according to the gasified gas production system 400 of the present embodiment, tar can be reformed with high efficiency while reducing consumption of a combustible gas (hydrogen or methane). In addition, with the configuration of the oxidation agent supply unit 430 supplying the combustion exhaust gas EX1 to the catalyst as an oxidation agent with a high temperature, consumption of the combustible gas can be reduced and a decrease of a combustible gas included in the gasified gas X2 can be further suppressed in comparison to a case in which an oxidation agent with a relatively low temperature is supplied to the catalyst.

Furthermore, since power for supplying the oxidation agent is not needed, consumption energy required for such power can be cut.

Although exemplary embodiments of the present disclosure have been described so far with reference to the accompanying drawings, the present disclosure is not limited to these embodiments. It is obvious that a person skilled in the art can conceive various modified or altered examples within the scope described in the claims that come within the technical range of the present disclosure.

For example, in the first embodiment described above, the case in which the oxidation agent supply unit 230 heats the oxidation agent OX with the heat of the combustion exhaust gas EX1 and supplies the oxidation agent to the catalyst has been described as an example. However, the oxidation agent supply unit 230 may supply an oxidation agent having a high temperature of 200° C. to 900° C. to the catalyst, and may supply the oxidation agent OX heated with, for example, a heater to the catalyst.

In addition, in the first embodiment described above, the case in which the heat exchanger 236 performs heat exchange between the combustion exhaust gas EX1 flowing between the medium separator 114 and the boiler 152 and the oxidation agent OX has been described as an example. However, there is no limit on the medium with which the heat exchanger 236 performs heat exchange as long as the oxidation agent OX can be heated to a temperature of 200° C. to 900° C. For example, since the combustion exhaust gas EX2 flowing between the denitrification device 154 and the desulfurization device 156 (on the exhaust passage 158) is at a temperature of about 200° C. to 400° C., the heat exchanger 236 may perform heat exchange between the combustion exhaust gas EX1 flowing between the denitrification device 154 and the desulfurization device 156 and the oxidation agent OX to heat the oxidation agent OX to a temperature of 200° C. to 900° C.

In addition, the configuration in which the butterfly valve 434 is included in the exhaust passage 158 which connects the denitrification device 154 and the desulfurization device 156 has been described in the second embodiment described above; however, the butterfly valve 434 may be provided on the exhaust passage which connects the boiler 152 and the denitrification device 154.

In addition, in the embodiments described above, the oxidation agent control units 250 and 450 adjust the supply amount of the oxidation agent OX (or the combustion exhaust gas EX1) that the oxidation agent supply units 230 and 430 are caused to supply based on the temperature of the catalyst measured by the temperature-measuring unit 240. However, when the temperature of the gasified gas X1 is substantially uniform such as when there is no change in an operation state of the gasification furnace 116, the supply amount of the oxidation agent that the oxidation agent supply units 230 and 430 are caused to supply may be adjusted according to a rate of flow of the gasified gas X1 flowing on the flow passage 210.

In addition, although the case in which tar included in the gasified gas X1 that is produced in the gasification furnace 116 in which gasification of water vapor is performed is reformed has been described as an example in the first and second embodiments described above, there is no limit on a gasifying agent, and for example, it may be nitrogen or the like.

INDUSTRIAL APPLICABILITY

The present disclosure further controls reduction of a combustible gas while removing tar with good efficiency in a gasified gas production system for producing a gasified gas by gasifying a gasification raw material.

The invention claimed is:

1. A gasified gas production system comprising:

a gasification furnace which produces a gasified gas by gasifying a gasification raw material;

a flow passage through which the gasified gas produced by the gasification furnace flows;

a catalyst-holding unit which holds a catalyst inside the flow passage and promotes reforming of tar included in the gasified gas by the catalyst inside the flow passage;

an oxidation agent supply unit which supplies an oxidation agent with a temperature of 200° C. to 900° C. to the catalyst, a combustion furnace which heats a fluid medium with heat generated by combusting a fuel, wherein the fluid medium heated by the combustion furnace is introduced into the gasification furnace, and the gasification furnace gasifies the gasification raw material with heat of the fluid medium, and wherein the oxidation agent supply unit supplies a combustion exhaust gas with a temperature of 200° C. to 900° C. generated by combusting the fuel in the combustion furnace to the flow passage that connects the gasification furnace and the catalyst-holding unit as the oxidation agent.

2. The gasified gas production system according to claim 1, further comprising:

a temperature-measuring unit which measures a temperature of the catalyst; and an oxidation agent control unit which controls an amount of the oxidation agent supplied by the oxidation agent supply unit according to the measured temperature of the catalyst.

3. The gasified gas production system according to claim 1, wherein water vapor is introduced into the gasification furnace, and the gasification furnace gasifies the gasification raw material with the water vapor.

4. The gasified gas production system according to claim 2, wherein water vapor is introduced into the gasification furnace, and the gasification furnace gasifies the gasification raw material with the water vapor.

5. A gasified gas production system comprising:

a gasification furnace which produces a gasified gas by gasifying a gasification raw material;

a flow passage through which the gasified gas produced by the gasification furnace flows;

a catalyst-holding unit which holds a catalyst inside the flow passage and promotes reforming of tar included in the gasified gas by the catalyst inside the flow passage;

an oxidation agent supply unit which supplies an oxidation agent with a temperature of 200° C. to 900° C. to the catalyst, a combustion furnace which heats a fluid medium with heat generated by combusting a fuel, the combustion furnace is operably connected to the gasification furnace and configured to introduce the heated fluid medium into the gasification furnace and gasify the gasification raw material with heat of the fluid medium, and the oxidation agent supply unit is operably connected to the combustion furnace and configured to supply a combustion exhaust gas with a temperature of 200° C. to 900° C. generated by combusting the fuel in the combustion furnace to the flow passage that connects the gasification furnace and the catalyst-holding unit as the oxidation agent.

* * * * *